United States Patent [19]

Adams

[11] 4,232,194

[45] Nov. 4, 1980

[54] VOICE ENCRYPTION SYSTEM

[75] Inventor: Robert H. Adams, Sun Valley, Calif.

[73] Assignee: Ocean Technology, Inc., Burbank, Calif.

[21] Appl. No.: 21,255

[22] Filed: Mar. 16, 1979

[51] Int. Cl.[3] ..... H04K 1/06

[52] U.S. Cl. ..... 179/1.5 R; 179/1 SA

[58] Field of Search ..... 179/1 SA, 1.5 R, 1.5 S, 179/1.5 FS, 1.5 E

[56] References Cited

U.S. PATENT DOCUMENTS

| | | | |
|---|---|---|---|
| 3,773,977 | 11/1973 | Guanella | 178/22 |
| 4,100,374 | 7/1978 | Jayant et al. | 179/1.5 R |
| 4,149,035 | 4/1979 | Frutiger | 179/1.5 R |

OTHER PUBLICATIONS

E. Brunner, "Efficient Speech Scrabling", Conference Record: International Conf. on Communications etc., England, Jun. 1976, pp. 336–339.

D. Kahn, "The Codebreakers," Weidenfeld–Nicolson.

*Primary Examiner*—Malcolm A. Morrison

*Assistant Examiner*—E. S. Kemeny

*Attorney, Agent, or Firm*—Harris, Kern, Wallen & Tinsley

[57] ABSTRACT

An apparatus and method of voice encryption uses segment swapping. Features of the invention include weighting the input time-function segments by a Hamming or Hanning Window function, before converting to frequency domain segments.

17 Claims, 5 Drawing Figures

VOICE ENCRYPTION SYSTEM

BACKGROUND OF THE INVENTION

This invention relates to method and apparatus for voice encryption and in particular to a new and improved voice encryption system which is small enough to be portable, while being reliable and having a very high probability that the encryption cannot be broken in a reasonable amount of time. While a voice signal is referred to in the specification and claims, it will be understood that the system is applicable to any audio signal; the voice signal is referred to in the discussion because voice encryption is the most common usage for such systems.

In a typical encryption system, the voice signal is encoded or converted to another signal which is then transmitted to a receiver where it is decoded or reconverted back to the original voice signal. The signal transmission may be by various means and the present invention will be described in conjunction with a conventional telephone transmission line.

One type of encryption system utilized in the past is the frequency scrambling system wherein the audio signal is connected as an input to each of a bank of analog filters which function to separate the analog signal into a plurality of frequency segments. In the encoder, the sequence of the segments is transposed or swapped to higher or lower frequency bands and the resultant analog signals are combined for transmission. In the decoder, the reverse of the operation is performed to reproduce the original voice signal. This system is not satisfactory because analog filters have limitations in frequency resolution which permit only a few frequency segments to be used. By way of example, with the standard telephone circuit a bandwidth of 2560 Hertz is used to carry the voice information. An analog filter system in this bandwidth cannot utilize more than 5 to 10 frequency bands. A five bank system provides only 120 possible frequency transpositions or scrambling combinations. A ten bank system provides about $3\times10^6$. While this number of possible combinations would provide some security, operation with ten analog filters in the standard telephone bandwidth is exceedingly difficult.

Accordingly, it is an object of the present invention to provide a new improved voice encryption method and apparatus which can utilize many more frequency bands and provide a very high number of scrambling combinations. By way of example, a system with 16 frequency bands or segments will provide $2\times10^{13}$ possible combinations and a system with 64 segments will provide $10^{89}$ possible combinations.

The previously described prior art system is all analog. In another prior art encryption system, signals are digitally processed in various ways providing a digital output for transmission. For a high quality encryption system, a relatively wide transmission bandwith is required.

It is an object of the present invention to provide a new and improved method and apparatus for voice encryption which can handle a variety of audio inputs resulting from various speakers utilizing different languages, accents and dialects, and which provides an analog output with narrow bandwidth capability, while at the same time utilizing digital processing.

It is also an object of the invention to provide a means of changing the transposing or swapping order at frequent intervals during a voice transmission to provide a different sequence. The security of the voice communication is greatly enhanced by changing the swapping order several times a second, preferably at least 5 times a second. This greatly disguises audible patterns in the cipher, which are very useful in intercepting the communication. These and other objects, advantages, features and results will more fully appear in the course of the following description.

SUMMARY OF THE INVENTION

In the voice encryption of the invention, encoding is accomplished by converting an analog voice signal to a digital signal, separating the digital signal into a plurality of segments in a sequence with each segment representing a band of the frequency spectrum of the digital signal, transposing the sequence of the segments, combining the transposed segments to produce an encoded digital signal, and converting the encoded digital signal to an encoded analog signal suitable for transmission. The decoding method is the reverse of the encoding method.

In the preferred embodiment, the output of the analog to digital converter is a sequence of digital words. This sequence of words is organized into a system of overlapping records. For a Hanning or Hamming window, the degree of overlap desirably should be 50%; i.e., the last 128 points of a 256 word record will be made first 128 points of the next record. The spectrum of each record, suitably weighted by a Hanning or other windowing function, is separated into a plurality of segments using a fast Fourier transform algorithm. After the segments have been transposed according to the encryption rule, an inverse fast Fourier transform is used to transform the encrypted spectral data back into the time domain. The records of data generated by the inverse fast Fourier transform are overlapping in the same way as the input records. To eliminate the modulation due to the Hanning window, each data point in a record is summed with the corresponding data point in the overlapping record. The results of this summation process are converted to an analog signal by means of a digital-analog converter. Encoding and decoding are done in an identical manner except that the segment transposition rule for decoding is the inverse of the segment transposition rule for encoding.

In those embodiments in which the transportation rule remains fixed during a transmission, the transmission can be considered one block of overlapping records. In those embodiments in which the transposition rule is changed during a transmission, the transmission can be considered a sequence of blocks of overlapping records in which the transposition rule is changed between each consecutive pair of blocks. In order to eliminate the Hanning modulation which occurs at the beginning and end of each block, the first two records of a block are repeats of the last two records in the previous block. This permits the receiver system to discard data contaminated with Hanning modulation without losing any recovered voice data.

The invention also includes apparatus for performing the methods described above.

DESCRIPTION OF THE PREFERRED EMBODIMENTS

Figure 1:
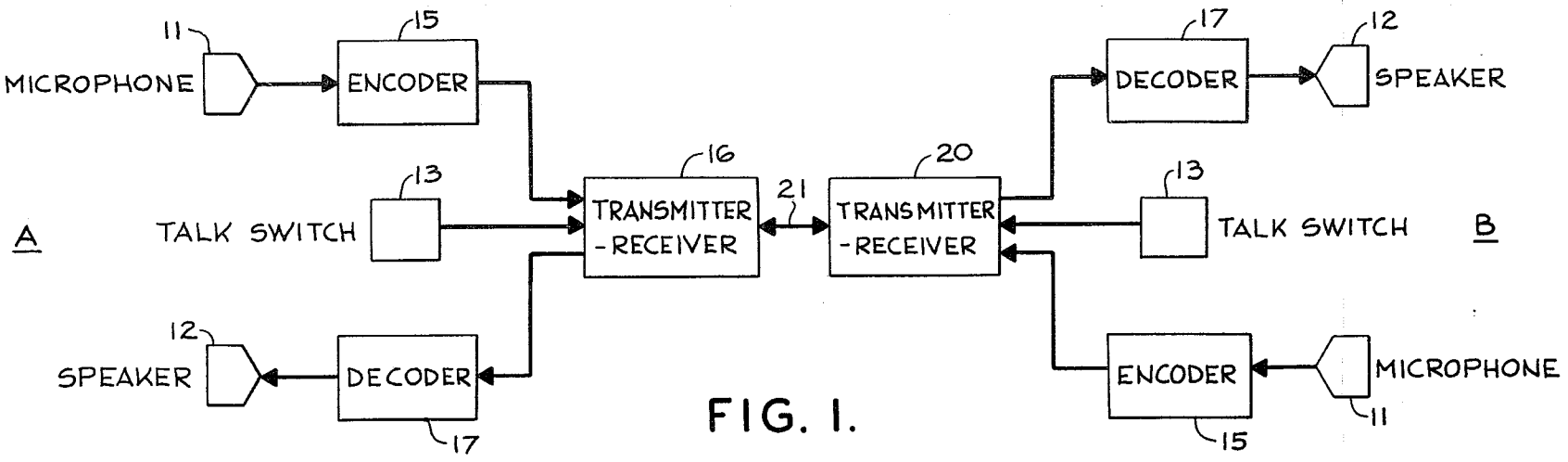
FIG. 1 is a block diagram of a communication system providing for two-way communication between two points.

FIG. 1 illustrates a system for two-way communication between points A and B. A microphone 11, speaker 12 and push to talk switch 13 are provided for the party at point A. Typically this could be a conventional telephone handset with a push to talk button. A similar arrangement is provided for the party at point B. The microphone 11 is connected to an encoder 15 with the encoder output connected to a transmitter-receiver unit 16. The transmitter-receiver unit 16 is connected to a decoder 17 which is connected in turn to the speaker 12, with the switch 13 being connected to the unit 16. A similar transmitter-receiver unit 20 is provided at point B, with the units 16, 20 interconnected by any conventional means, such as a telephone line 21.

The operation of the system of FIG. 1 is conventional. When the party at point A wishes to speak, the switch 13 is closed and the party speaks into the microphone 11. The voice signal is encoded at 15 and the encoded signal is connected to the unit 16 for transmission to the unit 20 where the encoded signal is connected to the decoder and to the speaker. When the party at point A is finished speaking, the switch 13 is released, and the party at point B may then speak in the same manner.

Figure 2:
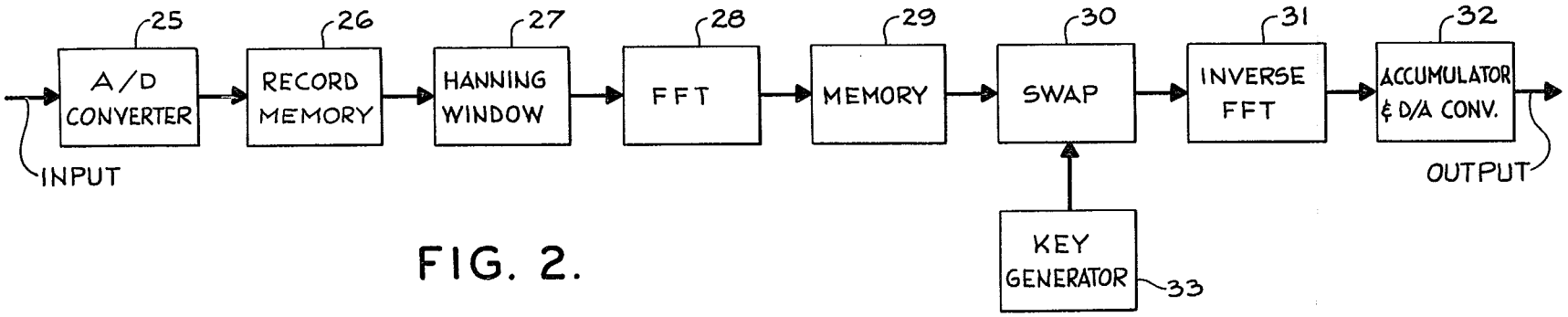
FIG. 2 is a block diagram of an encoder or decoder for the system of FIG. 1 and incorporating the presently preferred embodiment of the invention.

The presently preferred embodiment for the encoder 15 and decoder 16 is shown in FIG. 2. The encoder and decoder are constructed and operated in the same manner, with the segment transposition rule or swap key of one being the inverse of that of the other. Hence the following description of the encoder applies equally to the decoder.

The encoder includes an analog-to-digital converter 25, a record memory unit 26, a Hanning window unit 27, a fast Fourier transform unit 28, a memory 29, a swap unit 30, an inverse fast Fourier transform unit 31, an accumulator and digital-to-analog converter 32, and a key generator 33. Each of these units may be a conventional unit.

A weighting window is desired at the input to the fast Fourier transform unit, preferably of the trignometric type, such as a Hanning window, a Hamming window or a Blackman window. The embodiment described herein incorporates a Hanning window.

The input analog voice signal passes to the analog-to-digital converter 25, where the analog signal is converted into a stream of digital words. These digital words are stored in the record memory 26 which has sufficient capacity to permit the data stream to be organized into a set of overlapping records.

Each record is then handled separately in the swapping operation. The records are weighted by the Hanning window. Each record is then converted to a complex spectrum by the fast Fourier transform unit with the spectrum being stored in the memory 29. Individual segments of the spectrum are transposed or interchanged or swapped to provide the encryption and the cipher data record is reconstructed from the transposed spectrum by an inverse fast Fourier transform. The swapping typically is carried out by fetching out the segments of a spectrum from memory to the inverse fast Fourier transform unit in a sequence or order different from that in which the segements are stored in the memory. A stream, of cipher data words are then generated from the overlapping cipher data records by summing the corresponding points in the overlapping cipher data records. These cipher data points are converted into an analog signal by the digital-to-analog converter 32.

The present embodiment of the system is designed for operation with the conventional telephone bandwidth of 2560 Hertz. In one embodiment, 16 frequency bands, each 160 Hertz wide, are provided in the spectrum analysis, providing $2\times10^{13}$ swapping permutations. In another embodiment, 64 frequency bands with a bandwidth of 40 Hertz each may be used providing $10^{89}$ swapping permutations.

Figure 3:
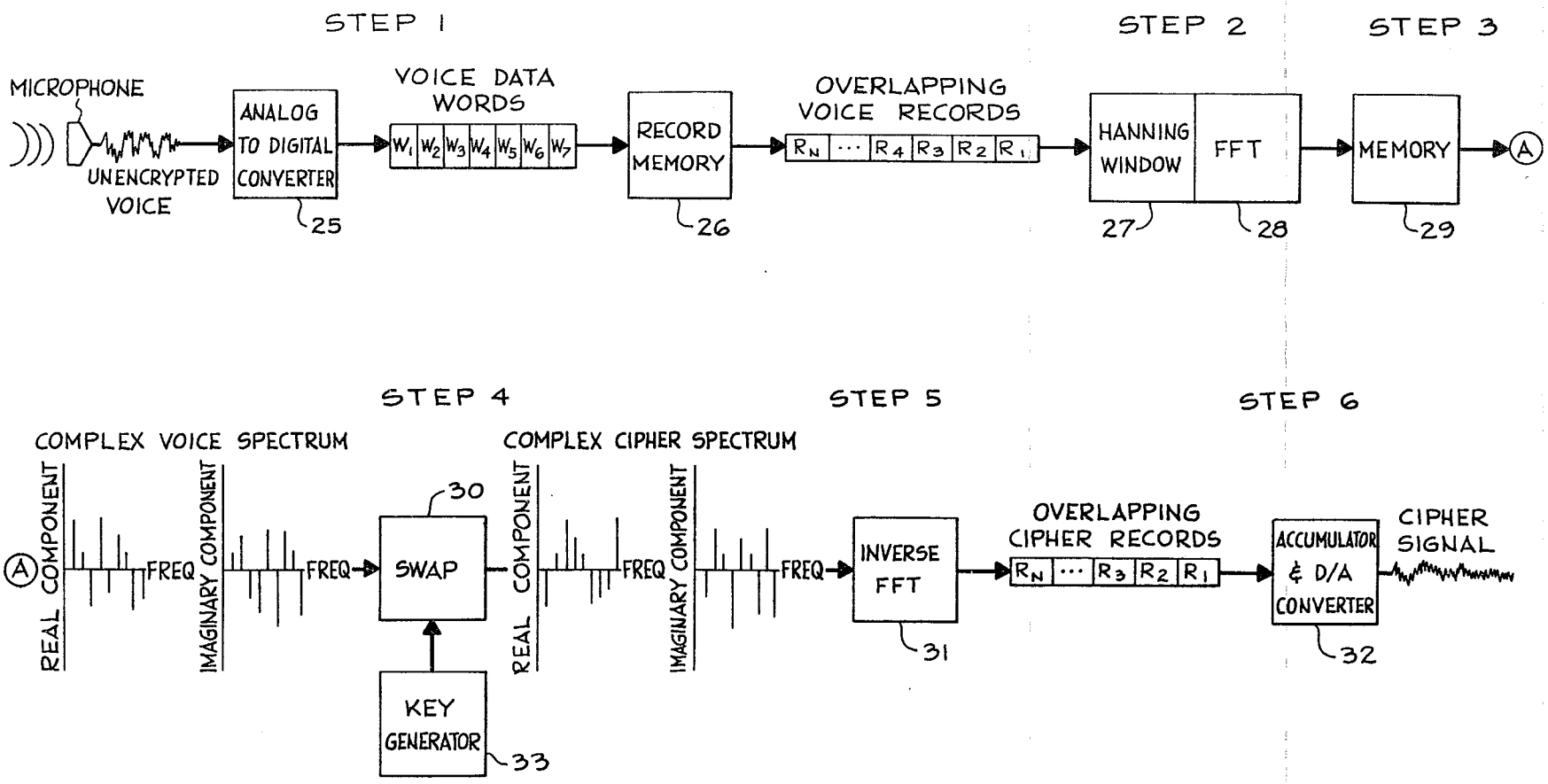
FIG. 3 is a diagram illustrating the operation of the encoder and decoder of FIG. 2.

The operation of the encoder is further described in conjunction with FIG. 3. The voice signal spoken into the microphone 11 is converted into a digital pulse train (Step 1) and stored in a memory 26 in time records 25 to 100 milliseconds long (records: $R_1$, $R_2$, . . . $R_n$). Each record is sequentially fetched out of the memory and converted into a frequency versus amplitude format using a fast Fourier transform (FFT) circuit 28 (Step 2). This frequency format ($F_1$, $F_2$, . . . $F_n$) is then stored in memory 29 (Step 3).

The swapping or scrambling takes place when the frequencies stored in the memory 29 in Step 3 are fetched out in a different order than stored, based on a predetermined encryption sequence (Step 4). The resultant spectrum is then retransformed into overlapping time oriented digital records using the inverse fast Fourier transform unit 31 (Step 5). These digital records are then reconverted into an analog format (Step 6) for transmission. At the receiver end the process is repeated using the inverse of the encryption sequence to restore the original signal intelligence.

Figure 4:
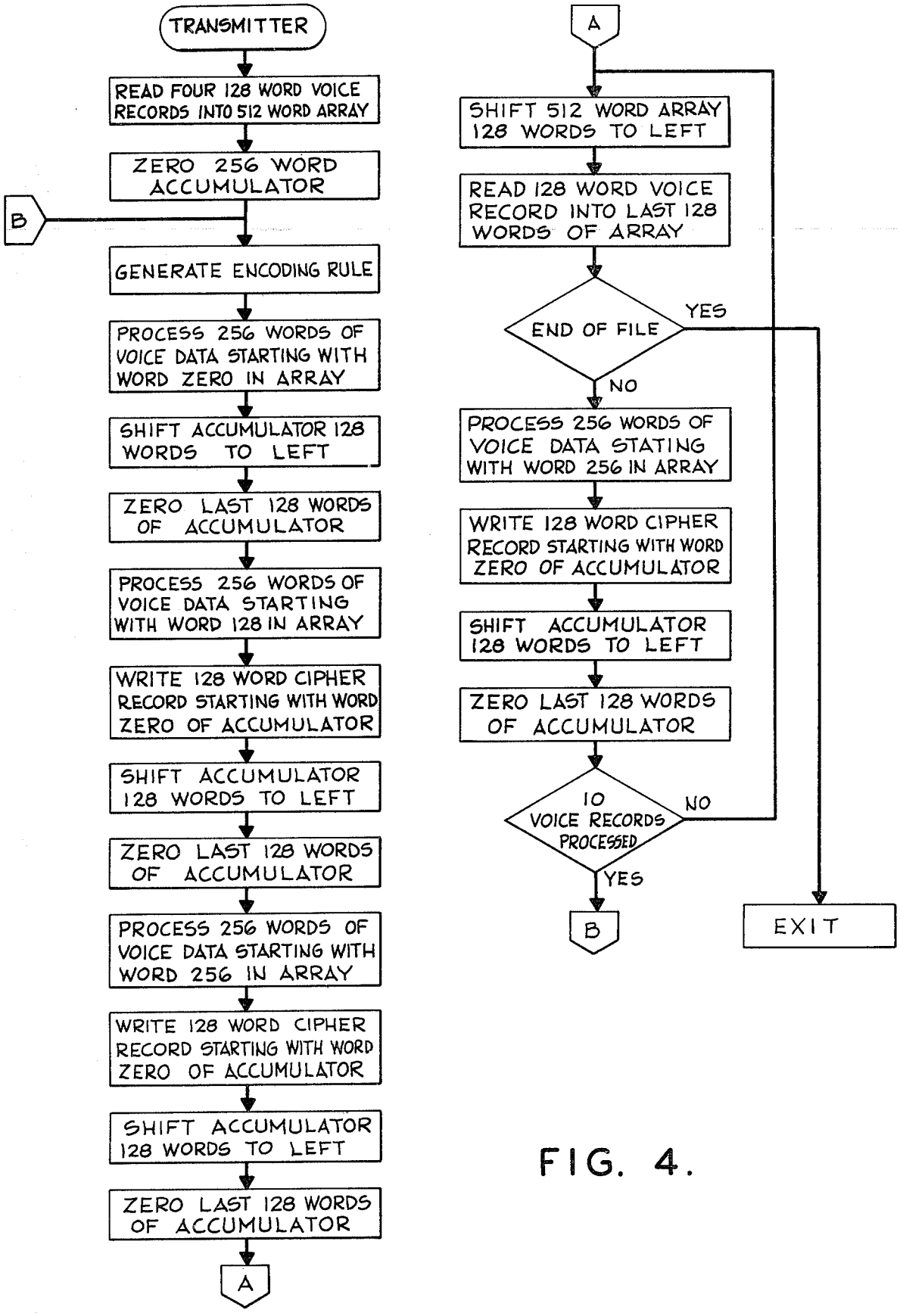
FIG. 4 is a flow chart illustrating operation of the encoder.
Figure 5:
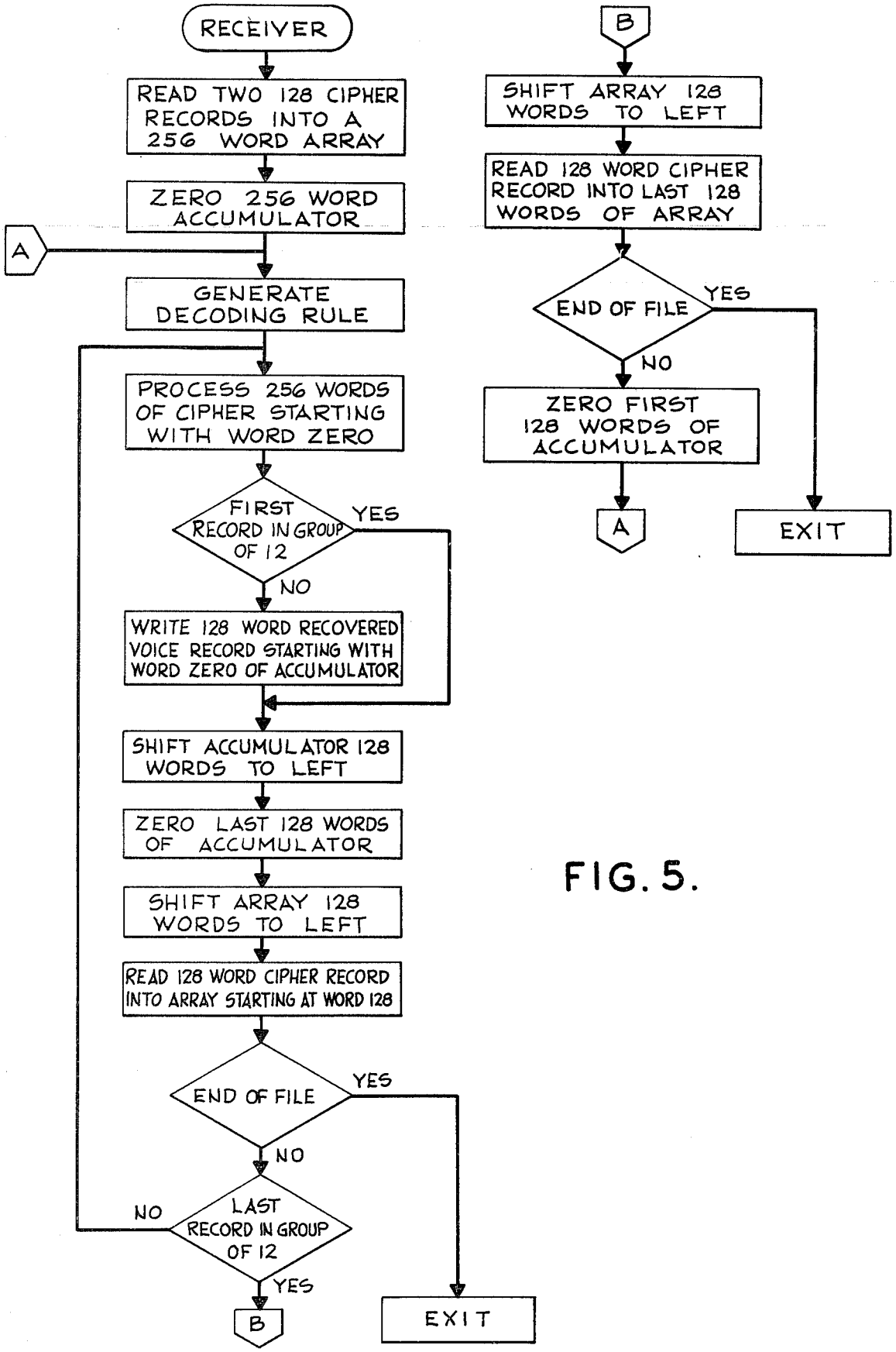
FIG. 5 is a flow chart illustrating operation of the decoder.

FIGS. 4 and 5 are flow charts for the encoding and decoding operations, respectively. In the flow chart of FIG. 4, the transposition rule is changed at regular intervals during a transmission. By way of example, each transposition rule is used for the processing of thirteen overlapping voice records. An array capable of storing three overlapping records is provided. For each group of thirteen overlapping records, the transmitter processes the first overlapping record in the array and sends no cipher data; processes the second and third overlapping records in the array sending cipher data; and then updates the array with voice data, processes the third overlapping record in the array, and sends cipher ten times. Upon starting a new group of thirteen overlapping records, the first overlapping record is processed without updating the array with new voice data. Hence the transmitter reprocesses, using the new transposition rule, voice data that it has already processed. For every 1280 data words of voice read during the processing of a group, the transmitter will send 1536 words of cipher in an analog form.

Referring to the flow chart of FIG. 5, in the receiver or decoder for the same example, each transposition rule is used for the processing of twelve overlapping records. For each group of overlapping records, the receiver will process the first record and send no recovered voice data; then process eleven more records sending voice data. At the end of a group, the accumulator is cleared and the process is restarted with fresh cipher data and a new transposition rule.

The key generator 33 provides a set of random numbers for the swapping order changes and various means for producing a set of random numbers may be used. One suitable algorithm written in PL1 for the key generator is set out in Table 1. The transposition of the sequence of the segments resulting from the fast Fourier transform takes place at the swap unit 30. One suitable algorithm, also written in PL1, for the transposition is set out in Table 2.

TABLE 1

```
/*          KEY GENERATOR -                                          */
/*           SWAP-TABLE USED TO TRANSPOSE FREQUENCY BINS             */
/*           KDIRECT-FLAG (0 = TRANSMIT, 1 = RECEIVE)                */
/*           RANDOM-GENERATOR SEED, INITIALIZED AT KEY               */
KEYGEN:     PROCEDURE (SWAMP, RANDOM, KDIRECT);
            DECLARE
             SWAP (0:255) FIXED BINARY (15,0),
             RANDOM FIXED BINARY (31,0),
             NUMBERS (29) FIXED BINARY (15,0);
/*                                                                   */
/*          THE RANDOM GENERATOR IS RUN                              */
/*                                                                   */
            Dϕ I = 1 Tϕ 29;
             RANDϕM = 1057 *RANDϕM + 3251;
             I1 = RANDϕM / 65536;
             RANDOM = RANDϕM - I1 * 65536;
/*                                                                   */
/*          EACH RANDOM NUMBER IS SCALED TO RANGE BETWEEN            */
/*          0 AND 29                                                 */
/*                                                                   */
             I1 = RANDϕM / 30;
             I1 = RANDϕM - I1 * 30;
/*                                                                   */
/*          AN ANTI-CRASH FEATURE IS ADDED                           */
/*                                                                   */
             I2 = 30 - I;
             I3 = I1 / I2;
             NUMBER (I) = I1 - I2 * I3 + I + 1;
             END;
/*                                                                   */
/*          ENCODE / DECODE IS SELECTED                              */
/*                                                                   */
            IF KDIRECT = 1
             THEN Dϕ;
              KSTART = 1;
              KEND = 29;
              KBY = 1;
              END;
             ELSE Dϕ;
              KSTART = 29;
              KEND = 1;
              KBY = -1;
              END;
/*                                                                   */
/*          SWAP IS INITIALIZED.                                     */
/*                                                                   */
            Dϕ I = 0 TO 255;
             SWAP (I) = I;
             END;
/*                                                                   */
/*          SWAP IS PREPARED                                         */
/*                                                                   */
            Dϕ I = KSTART Tϕ KEND BY KBY;
             I1 = NUMBER (I);
             Dϕ J = 0 Tϕ 3;
              J1 = 4 * I + J;
              J2 = 4 * I1 + J;
              Dϕ K = 1 Tϕ 2;
               K1 = SWAP (J1);
               SWAP(J1) = SWAP(J2);
               SWAP(J2) = K1;
               J1 = 256 - J1;
               J2 = 256 - J2;
               END;
              END;
             END;
            RETURN.
            END;
```

One suitable algorithm written in PL1 for the key gen-

TABLE 2

```
/*                                                                   */
/*          TRANSPOSITION ALGORITHM                                  */
/*           REAL IN - REAL ARRAY FROM FFT                           */
```

TABLE 2-continued

```
/*      IMAGIN - IMAGINARY ARRAY FROM FFT                          */
/*      REALOUT - REAL ARRAY TO INVERSE FFT                        */
/*      IMAGOUT - IMAGINARY ARRAY TO INVERSE FFT                   */
/*      SWAP - TRANSPOSITION ARRAY                                 */
TRANS:  PROCEDURE (REALIN, IMAGIN, SWAP, REALOUT, IMAGOUT);
        DECLARE
         REALIN    (0:255)  FIXED BINARY (15,0),
         IMAGIN    (0:255)  FIXED BINARY (15,0),
         SWAP      (0:255)  FIXED BINARY (15,0),
         REALOUT   (0:255)  FIXED BINARY (15,0),
         IMAGOUT   (0:255)  FIXED BINARY (15,0);
        Dϕ I = 0 Tϕ 255;
         REALϕUT (I) = REALIN (SWAP (I));
         IMAGϕUT (I) = IMAGIN (SWAP (I));
         END;
        RETURN;
        END;
```

I claim:

1. In an encoder or decoder for a voice encryption system, the combination of:

an analog-to-digital converter for converting a first analog signal to a sequence of digital words;

storage means for storing words from said analog-to-digital converter output in overlapping first records;

weighting means having the overlapping digital records as an input for producing digital records in the time domain and weighted by a window function;

first means for converting a time domain weighted record to the frequency domain producing a plurality of digital segments each representing a different frequency band;

means for transposing segments of said digital segments;

means for combining said transposed segments to produce a second record in the frequency domain;

second means for converting a frequency domain digital second record to a time domain digital second record;

accumulator means for storing time domain second records; and a digital-to-analog converter for converting said time domain second records to a second analog signal.

2. Apparatus as defined in claim 1 wherein said first means for converting includes a fast Fourier transform circuit, and said second means for converting includes an inverse fast Fourier transform circuit.

3. Apparatus as defined in claim 2 wherein said weighting means includes means providing a trignometric window.

4. Apparatus as defined in claim 2 wherein said first means for converting produces at least 16 segments.

5. Apparatus as defined in claim 2 wherein said first means for converting produces at least 64 segments.

6. Apparatus as defined in claim 2 wherein said weighting means includes means providing a trignometric window with a record overlap of about 50 percent.

7. Apparatus as defined in claim 6 wherein said trignometric window is a Hanning window.

8. Apparatus as defined in claim 6 wherein said trignometric window is a Hamming window.

9. Apparatus as defined in claim 1 wherein said means for transposing selectively transposes segments in response to a key signal, and including:

a key signal generator; and means for connecting the key signal of said generator to said means for transposing.

10. In a method of voice encryption, the steps of:

converting a first analog signal to a sequence of digital words in the time domain;

storing said words in overlapping records;

processing the overlapping records by means of a data window weighting function to produce digital weighted records in the time domain;

converting a time domain digital weighted record to the frequency domain producing a plurality of digital segments in a sequence, with each segment representing a different frequency band;

transposing the sequence of the segments;

combining the transposed segments to produce an encoded digital record in the frequency domain;

converting the frequency domain encoded digital record to an encoded digital record in the time domain;

accumulating encoded time domain digital records; and converting encoded time domain digital records to a second analog signal.

11. The method as defined in claim 10 including the step of changing the sequence to which the segments are transposed.

12. The method as defined in claim 10 including converting a time domain record to the frequency domain by a fast Fourier transform and converting a frequency domain record by an inverse fast Fourier transform.

13. The method of claim 12 including weighting the time domain records with a trignometric window prior to converting to the frequency domain.

14. The method of claim 12 including weighting the records with a trignometric window with a 50 percent overlap prior to converting to the frequency domain.

15. The method of claim 14 including weighting the records with a Hanning window prior to converting to the frequency domain.

16. The method of claim 14 including weighting the records with a Hamming window prior to converting to the frequency domain.

17. The method of claim 13 including:

converting, transposing and combining a first group of records in a first sequence;

changing the sequence to which the segments are transposed to a second sequence;

converting, transposing and combining a second group of records in the second sequence, using at least the last record of said first group as the first record or records of said second group.

* * * * *